US005594459A

United States Patent [19]

Hirota

[11] Patent Number: 5,594,459

[45] Date of Patent: Jan. 14, 1997

[54] RETRACTABLE/EXTENSIBLE ANTENNA WITH INNER AND OUTER SECTIONS HAVING A FEED POINT COIL AND END MOUNTED COIL

[75] Inventor: Katsumi Hirota, Kanagawa, Japan

[73] Assignee: Sony Corporation, Tokyo, Japan

[21] Appl. No.: 518,725

[22] Filed: Aug. 24, 1995

[30] Foreign Application Priority Data

Sep. 6, 1994 [JP] Japan ..... 6-238427

[51] Int. Cl.[6] ..... H01Q 9/00

[52] U.S. Cl. ..... 343/749; 343/901; 343/702

[58] Field of Search ..... 343/749, 702, 343/900, 901, 906, 713, 715; H01Q 9/00, 1/24

[56] References Cited

U.S. PATENT DOCUMENTS

| | | | |
|---|---|---|---|
| 3,259,901 | 7/1966 | Bykerk | 343/749 |
| 4,462,033 | 7/1984 | Grashow | 343/749 X |
| 4,868,576 | 9/1989 | Johnson, Jr. | 343/702 |
| 4,958,382 | 9/1990 | Imanishi | 343/702 X |
| 5,504,494 | 4/1996 | Chatzipetros et al. | 343/702 |

*Primary Examiner*—Michael C. Wimer
*Assistant Examiner*—Tho Phan
*Attorney, Agent, or Firm*—Jay H. Maioli

[57] ABSTRACT

An antenna used for a portable telephone includes a cylindrical outer conductor, an inner conductor, first and second coils and a contact. The inner conductor is disposed inside the outer conductor and is movable between a position wherein it has been pulled out from one end of the outer conductor and a position wherein it has been received into the outer conductor. The first coil is connected between a feed point and a feed side end portion of the outer conductor. The second coil is mounted on an end portion of the inner conductor projecting from the outer conductor. The contact is mounted on the feed point. In the antenna, when the inner conductor has been received into the outer conductor, the inner conductor makes contact with the contact and the first coil is thereby shorted and the electrical length is supplemented by the second coil.

5 Claims, 3 Drawing Sheets

RETRACTABLE/EXTENSIBLE ANTENNA WITH INNER AND OUTER SECTIONS HAVING A FEED POINT COIL AND END MOUNTED COIL

BACKGROUND OF THE INVENTION

1. Field of the Invention

This invention relates to an antenna and, particularly to a telescopic antenna having an outer conductor and an inner conductor.

2. Description of the Related Art

In some portable telephones telescopic antennas are used. FIGS. 1A and 1B show an example of the exterior appearance of such a portable telephone and telescopic antenna. In FIGS. 1A and 1B, a telescopic antenna 2 is attached to the top of the main body of a portable telephone 1 by way of a coaxial connector 3.

The telescopic antenna 2 shown in FIGS. 1A and 1B is of two-stage telescopic type. That is, when the portable telephone 1 is on standby the telescopic antenna 2 is in a retracted state as shown in FIG. 1A, and during calls the telescopic antenna 2 is in an extended state as shown in FIG. 1B. If the wavelength of the communications frequency used by the portable telephone 1 is written $\lambda$, the electrical length of the telescopic antenna 2 when retracted as shown in FIG. 1A is $\lambda/4$ and the electrical length of the telescopic antenna 2 when extended as shown in FIG. 1B is $\lambda/2$.

The portable telephone 1 can be made in a compact form, for example about 80 mm (height)×55 mm (width).

However, because portable telephones use frequencies in the 900 MHz band for transmission and reception, the wavelength $\lambda$ is about 33 cm. As a result, the length of the telescopic antenna 2 when retracted is about 83 mm, and when the length of the connector 3 is included the length of the telescopic antenna 2 as a whole is about 87 mm.

Consequently, when the portable telephone 1 is on standby and the telescopic antenna 2 is retracted as shown in FIG. 1A, the balance between the height of the portable telephone 1 and the length of the telescopic antenna 2 is poor. Also, because the length of the telescopic antenna 2 when it is retracted is $\lambda/4$, this places restrictions on the design of the portable telephone 1. Similar problems arise when the telescopic antenna 2 is extended as shown in FIG. 1B.

SUMMARY OF THE INVENTION

It is therefore an object of the present invention to provide an antenna which resolves the above-mentioned problems.

According to the present invention, there is provided an antenna comprising a cylindrical outer conductor, an inner conductor, first and second coils and a contact. The inner conductor is disposed inside the outer conductor. The inner conductor is mounted movably between a position wherein it has been pulled out from one end of the outer conductor and a position wherein it has been received into the outer conductor. The first coil is connected between a feed point and a feed side end portion of the outer conductor. The second coil is mounted on an end portion of the inner conductor projecting from the outer conductor. The contact is mounted on the feed point. In the antenna, when the inner conductor has been received into the outer conductor, the inner conductor makes contact with the contact and the first coil is thereby shorted and the electrical length is supplemented by the second coil.

BRIEF DESCRIPTION OF THE DRAWINGS

FIG. 1A shows the antenna retracted, and FIG. 1B shows the antenna extended;

FIG. 2A shows the antenna retracted, and FIG. 2B shows the antenna extended; FIG. 3A shows the antenna retracted, and FIG. 3B shows the antenna extended.

DETAILED DESCRIPTION OF THE PREFERRED EMBODIMENTS

Preferred embodiments of antennas according to the invention will now be described in detail with reference to the accompanying drawings. The antennas discussed below are described using antennas used for portable telephones as examples.

First, an antenna according to a first preferred embodiment of the invention will be described with reference to FIGS. 2A and 2B. The antenna of this first preferred embodiment is a type wherein an inner conductor which will be further discussed below moves or slides with respect to an outer conductor.

Figure 2A:
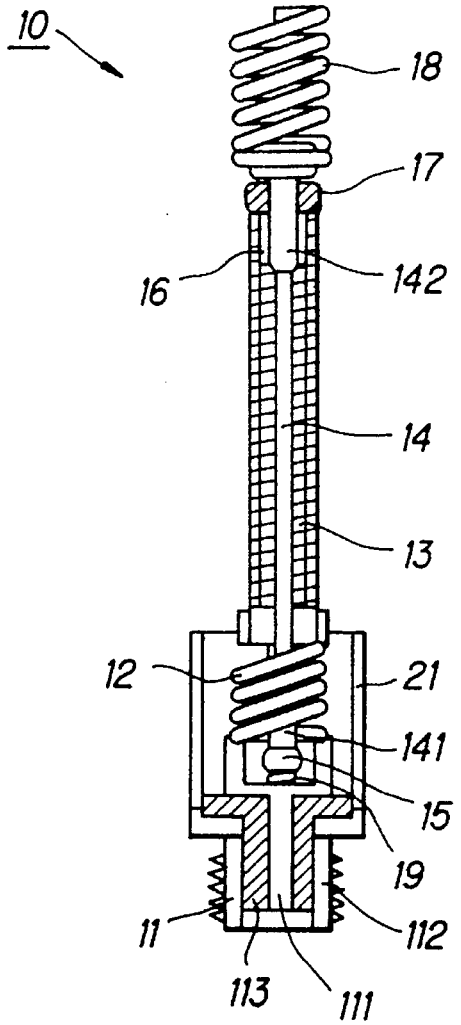
FIGS. 2A and 2B are sectional views showing the construction of an antenna according to a first preferred embodiment of the invention.
Figure 2B:
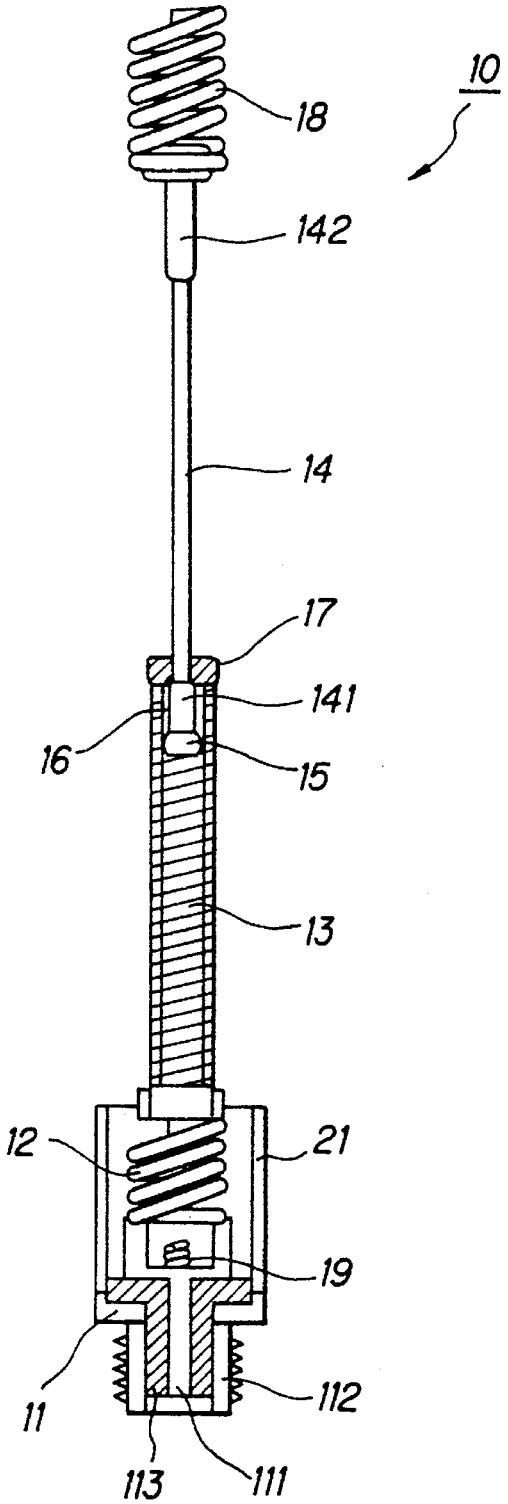

In FIGS. 2A and 2B, an antenna 10 comprises a connector plug 11 of a coaxial connector, and a coil 12 is coaxially mounted on a feed point, that is, a center contact (hot side conductor) 111, of this connector plug 11. In this preferred embodiment the coil 12 is for example formed of a coiled conducting wire having a suitable elasticity such as piano wire, and the lower end in FIGS. 2A and 2B of this coil 12 is fixed and electrically connected to the contact 111 of the connector plug 11.

An outer conductor 13 is attached to the other end of the coil 12. This outer conductor 13 is formed in a cylindrical shape by a bandlike conductor having a suitable elasticity such as a sheet spring being coiled so that adjacent turns of the coil are in contact with each other. This outer conductor 13 is mounted coaxially with the coil 12, and its lower end in FIGS. 2A and 2B is fixed and electrically connected to the upper end in FIGS. 2A and 2B of the coil 12.

An inner conductor 14 is mounted slidably in and out of the outer conductor 13, that is, slidably with respect to the outer conductor 13 between a position wherein it has been received inside the outer conductor 13 as shown in FIG. 2A and a position wherein it has been pulled out of the outer conductor 13 as shown in FIG. 2B. In this preferred embodiment, this inner conductor 14 is made of a conducting wire having a suitable elasticity such as piano wire, and has large diameter portions 141 and 142 of a thickness close to the internal diameter of the outer conductor 13 formed at the lower end and the upper end respectively of the inner conductor 14 as shown in FIGS. 2A and 2B. A substantially spherical contact 15 is provided at the end of the lower large diameter portion 141.

An annular contact 16 is mounted coaxially with the outer conductor 13 around the inner circumference of the upper end in FIGS. 2A and 2B of the outer conductor 13. Also, a ring 17 made of a plastic material or the like having elasticity is coaxially mounted on the upper end in FIGS. 2A and 2B of the outer conductor 13 around the inner conductor 14.

A coil 18 is coaxially mounted on and electrically connected to the upper large diameter portion 142 of the inner conductor 14, as shown in FIGS. 2A and 2B.

A contact 19 consisting of a coil spring is mounted on the position on the feed point, that is, the center contact 111 of the connector plug 11, which faces the contact 15. A cylindrical conductor 21 is coaxially mounted around the coil 12 with a predetermined gap being provided therebetween, and the lower end in FIGS. 2A and 2B of the cylindrical conductor 21 is attached and electrically connected to an outer conductor (cold side conductor) 112 of the connector plug 11. An insulating part 113 which insulates the contact 111 from the conductor 112 is disposed between the contact 111 and the conductor 112 of the connector plug 11.

Figure 1A:
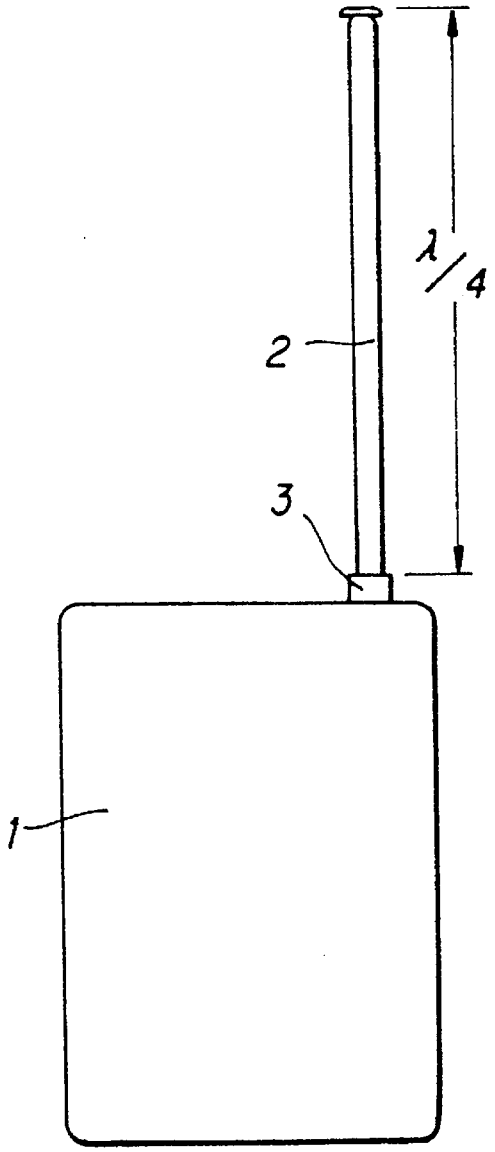
FIGS. 1A and 1B tare outline views showing the relationship between a portable telephone and an antenna.
Figure 1B:
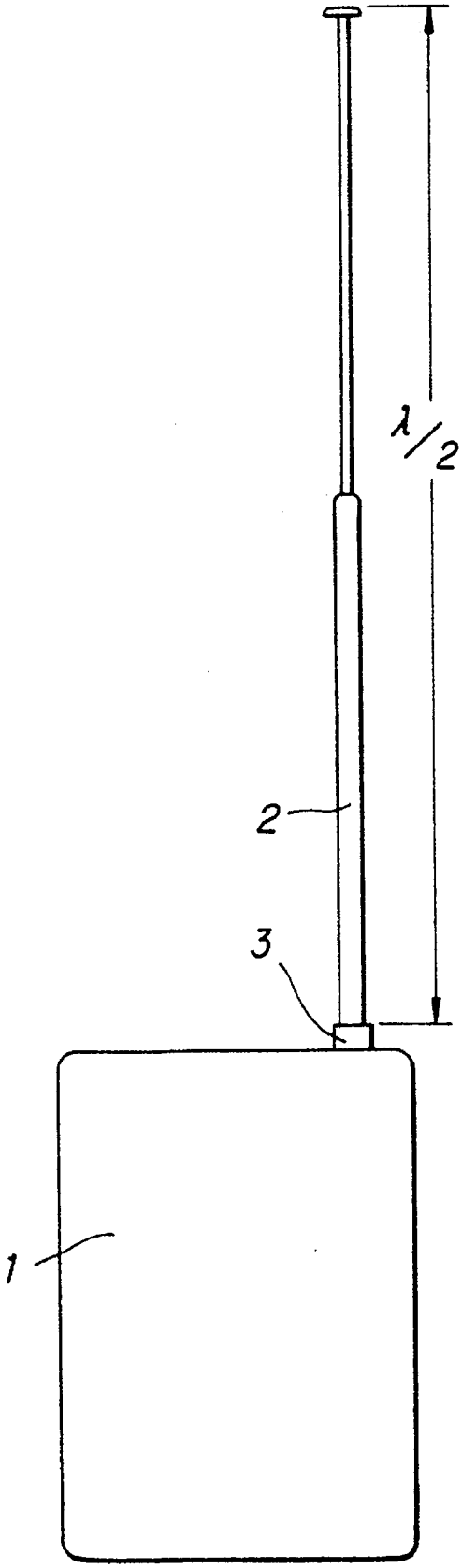

When the antenna 10 thus constructed is to be used, it is attached to the top of the portable telephone 1 shown in FIGS. 1A and 1B by the connector plug 11 being screwed into a connector jack of the coaxial connector 3 of the portable telephone 1.

In the antenna 10 shown in FIGS. 2A and 2B, when the inner conductor 14 is pushed in the direction of the connector plug 11, i.e. downward in FIG. 2B, the inner conductor 14 is received into the inside of the outer conductor 13 as shown in FIG. 2A. At this time the upper large diameter portion 142 of the inner conductor 14 is positioned in the ring 17 and the contact 16 and frictionally held by the ring 17 and the contact 16, and the inner conductor 14 will not come out of the outer conductor 13 and project from the outer conductor 13 as shown in FIG. 2B just as a result for example of the antenna 10 being turned upside down from the state shown in FIG. 2A. In other words, the inner conductor 14 is held in the state in which it is shown in FIG. 2A regardless of the orientation of the portable telephone.

At this time, because the contact 15 on the lower end of the inner conductor 14 makes contact with the contact 19 on the connector plug 11 side, the coil 12 is shorted by the inner conductor 14. The floating capacitance between the coil 12 and the cylindrical conductor 21 around it is also similarly shorted. As a result, for high frequencies, a length including the conductor 13, the conductor 14 retracted as shown in FIG. 2A and the coil 12 becomes the physical length of the antenna element. However, at this time, because the coil 18 is provided on the upper end of the inner conductor 14 and this coil 18 acts as a top loading coil, the electrical length of the conductor 13 and the retracted conductor 14 is supplemented in a direction such that it becomes longer than the physical length.

Therefore, by setting the impedance of the coil 18 to a predetermined value, even if the physical length of the conductors 13 and 14 when the conductor 14 is retracted is less than $\lambda/4$, it is possible to make their electrical length $\lambda/4$. In other words, the physical length of the antenna 10 when retracted can be made less than $\lambda/4$. By means of the coil 18, matching with the transmitting and receiving circuits can be effected.

When on the other hand the inner conductor 14 is pulled away from the connector plug 11, i.e. in the upward direction in FIG. 2A, the inner conductor 14 is pulled out of the outer conductor 13 as shown in FIG. 2B. At this time, the large diameter portion 141 is positioned in the contact 16, the large diameter portion 141 is frictionally held by the contact 16, and the inner conductor 14 will not drop just under its own weight into the outer conductor 13 to the state shown in FIG. 2A from the pulled-out state in which it is shown in FIG. 2B. In other words, the inner conductor 14 is held in the state in which it is shown in FIG. 2B. At this time, by the contact 15 abutting with the contact 16 and/or the large diameter portion 141 at the lower end of the inner conductor 14 abutting with the ring 17, the inner conductor 14 is prevented from coming right out of the outer conductor 13.

In this state shown in FIG. 2B, because for high frequencies the inner conductor 14 is connected to the outer conductor 13 in series, the length of this series connection is the physical length of the antenna element. However, at this time, the coil 12 acts as a matching coil and also acts as a bottom loading coil, and the electrical length of the antenna element is supplemented in a direction such that it becomes longer than its physical length. Also, the floating capacitance between the coil 12 and the conductor 21 around it acts to contribute to the electrical properties of the antenna.

Therefore, even through the physical length of the conductors 13 and 14 when extended is shorter than $\lambda/2$, by setting the impedance of the coil 12, the static capacitance due to the cylindrical conductor 21 and the physical length of the series connection of the conductors 13 and 14 to predetermined values, the electrical length of the antenna 10 when extended can be made $3\lambda/8$ to $5\lambda/8$. Matching with the transmission and reception circuits can be carried out by means of the static capacities of the coil 18 and the cylindrical conductor 21.

In the antenna 10 of FIGS. 2A and 2B, because there are provided the coil 18 which acts as a top loading coil and the coil 12 which acts as a bottom loading coil and when the antenna 10 is retracted as shown in FIG. 2A the coil 12 acting as a bottom loading coil is shorted, the retracted length of the antenna 10 can be made to have some design freedom and in principle matching with any kind of transmission and reception circuits is possible.

Therefore, the degree of freedom of the design of the antenna 10 in the retracted state shown in FIG. 2A is increased, and the aesthetic balance of when the antenna 10 is fitted to the portable telephone 1 proper can be improved. Also, restrictions on the design of the portable telephone 1 can be reduced.

Also, because it is possible to add static capacitance by providing the coil 18 acting as a top loading coil, the static capacitance due to the cylindrical conductor 21 can be reduced. As a result, the height of the cylindrical conductor 21, i.e. its length in the extension/retraction direction of the inner conductor 14, can be reduced, and the design freedom is increased in this way also.

Furthermore, because the outer conductor 13 consists of a coiled bandlike conductor such as a sheet spring and is attached to the coil 12, when the outer conductor 13 strikes something the outer conductor 13 or the coil 12 just bends at that time only and the outer conductor 13 does not break or become permanently bent.

Next, an antenna according to a second preferred embodiment of the invention will be described with reference to FIGS. 3A and 3B. The antenna of this second preferred embodiment has an intermediate conductor which will be further discussed later interposed between the outer conductor and the inner conductor, and the antenna extends and retracts in two stages.

Figure 3A:
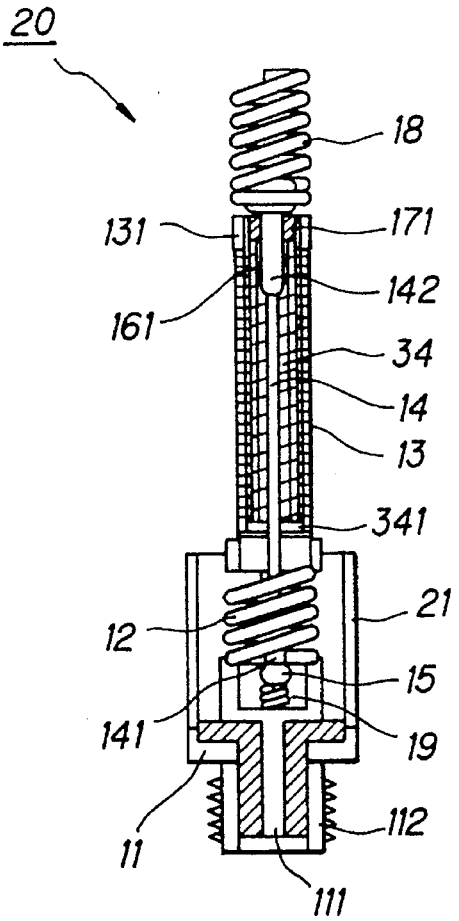
FIGS. 3A and 3B are sectional views showing the construction of an antenna according to a second preferred embodiment of the invention.
Figure 3B:
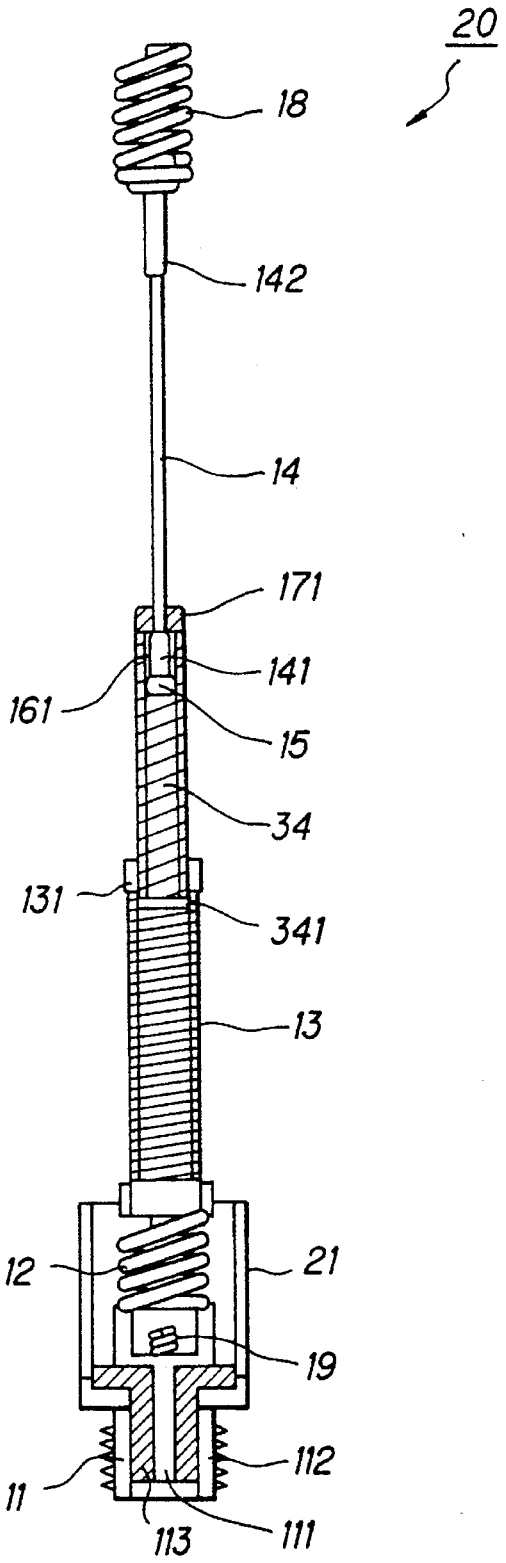

In FIGS. 3A and 3B, parts which are common with the first preferred embodiment described above have been given the same reference numerals and a detailed description thereof will be omitted.

As shown in FIGS. 3A and 3B, an antenna 20 has an intermediate conductor 34 interposed between an outer conductor 13 and an inner conductor 14. This intermediate conductor 34, like the outer conductor 13, is formed in a cylindrical shape by coiling a bandlike conductor having a suitable elasticity such as a sheet spring so that adjacent turns of the coil are in contact with each other. This intermediate conductor 34 is coaxially mounted retractably into the outer conductor 13, and the inner conductor 14 is coaxially mounted retractably into the intermediate conductor 34.

A large diameter portion 341 having a diameter larger than the diameter of the main part of the intermediate conductor 34 and substantially the same as the internal diameter of the outer conductor 13 is provided at the lower end in FIGS. 3A and 3B of the intermediate conductor 34, and an annular contact 161 is provided on the inner circumferential surface of the upper end of the intermediate conductor 34. Like the annular contact 16 mentioned above, this annular contact 161 frictionally holds the large diameter portion 141 at the lower end of the inner conductor 14 when the inner conductor 14 is pulled out of the intermediate conductor 34 as shown in FIG. 3B. As a result, as in the first preferred embodiment, the inner conductor 14 will not drop under its own weight into the intermediate conductor 34 from the state shown in FIG. 3B. A ring 171 made of an elastic synthetic resin material is attached to the upper end surface of the intermediate conductor 34.

A ring 131 made of a synthetic resin material or the like is attached to the upper end surface in FIGS. 3A and 3B of the outer conductor 13. Although not shown in the drawings, an annular contact is attached to the inner circumferential surface of the upper end of the outer conductor 13, and when the intermediate conductor 34 has been pulled out of the outer conductor 13 as shown in FIG. 3B, the large diameter portion 341 of the intermediate conductor 34 is held by frictional force acting between itself and the annular contact of the outer conductor 13. As a result, the intermediate conductor 34 will not drop into the outer conductor 13 under its own weight and the weight of the inner conductor 14. The antenna 20 thus constructed is attached to the portable telephone 1 proper shown in FIGS. 1A and 1B by the connector plug 11 being screwed into the jack in the upper surface of the portable telephone 1.

When the inner conductor 14 and the intermediate conductor 34 have been pulled out of the outer conductor 13, the large diameter portion 341 of the intermediate conductor 34 and the large diameter portion 141 at the lower end of the inner conductor 14 are held in the pulled-out state by the annular contact 161 of the intermediate conductor 34 and the annular contact of the outer conductor 13 as shown in FIG. 3B. At this time, as in the first preferred embodiment, matching of the antenna 20 with the transmission and reception circuits is achieved by way of the coil 12 and the cylindrical conductor 21, and by the impedance of the coil 12, the static capacitance of the cylindrical conductor 21 and the physical length of the series connection of the conductors 13, 14 and 34 being set to predetermined values in advance, the electrical length of the extended antenna 20 can be made $3\lambda/5$ to $5\lambda/8$.

The antenna 20 is brought from the state shown in FIG. 3B to the state shown in FIG. 3A, i.e. from the state wherein the inner conductor 14 and the intermediate conductor 34 have been pulled out of the outer conductor 13 to the state wherein the inner conductor 14 has been received inside the intermediate conductor 34 and the intermediate conductor 34 has been received inside the outer conductor 13, by the inner conductor 14 and/or the intermediate conductor 34 being pushed in the downward direction of FIG. 3B into the outer conductor 13.

As shown in FIG. 3A, when the antenna 20 is in its retracted state, that is, when the inner conductor 14 and the intermediate conductor 34 have been received into the outer conductor 13, as in the first preferred embodiment, the contact 15 of the inner conductor 14 makes contact with the contact of the connector plug 11 side and the coil 12 is shorted by the inner conductor 14. The floating capacitance between the coil 12 and the cylindrical conductor 21 is also shorted.

Because the retracted length of the antenna 20 of the second preferred embodiment can be made shorter than that of the antenna 10 of the first preferred embodiment, it is possible to increase the degree of design freedom of when the antenna 20 is retracted as shown in FIG. 3A and the freedom of the combination with the portable telephone 1 described above also increases.

As described above, with an antenna according to the invention, because there are provided a coil which acts as a top loading coil and a coil which acts as a bottom loading coil and when the antenna is retracted the coil acting as a bottom loading coil is shorted, the retracted length of the antenna can be made to have some design freedom and in principle matching with any kind of transmission and reception circuits is possible.

Therefore, the degree of freedom of the design of the retracted antenna is increased, and the aesthetic balance of when the antenna is fitted to a portable telephone can be improved. Also, restrictions on the design of the portable telephone can be reduced.

Also, because it is possible to add static capacitance by means of the top loading coil, the static capacitance due to the cylindrical conductor can be reduced. As a result, the height of the cylindrical conductor, i.e. its length in the extension/retraction direction of the inner conductor, can be reduced, and the design freedom is increased in this way also.

The invention is not limited to the preferred embodiments described above, and in any kind of multiple stage telescopic antenna the design freedom can be increased and independent matching circuits for when the antenna is retracted or when it is extended can be set. Also, the invention is not limited to application to a portable telephone and can of course be applied to other wireless communication devices such as transceivers.

What is claimed is:

1. An antenna comprising:

a cylindrical outer conductor;

an inner conductor arranged to be disposed inside the outer conductor, the inner conductor being movable between a first position wherein it has been pulled out from one end of the outer conductor and a second position wherein it has been received into the outer conductor;

a first coil connected between a feed point of the antenna and an end portion of the outer conductor at a feed side thereof;

a second coil mounted on an end portion of the inner conductor projecting from the outer conductor; and an electrical contact mounted on the feed point, wherein when the inner conductor has been received into the outer conductor the inner conductor contacts the electrical contact and the first coil is shorted and the electrical length is supplemented by the second coil.

2. An antenna according to claim 1, further comprising a further conductor arranged at the feed side of the outer conductor for forming a static capacitance with the first coil, wherein when the inner conductor has been pulled out of the outer conductor the electrical length is supplemented by the static capacitance formed between the first coil and the further conductor.

3. An antenna according to claim 1, further comprising a connector having a central contact arranged at the feed side of the outer conductor, wherein the central contact of the connector forms the feed point of the antenna.

4. An antenna according to claim 1, further comprising at least one intermediate conductor disposed parallel with and between the outer conductor and the inner conductor, wherein the at least one intermediate conductor is movable relative to at least one of the the outer conductor and the inner conductor.

5. An antenna according to claim 1, wherein lengths of the outer conductor and the inner conductor and impedances of the first coil and the second coil when the wavelength of the frequency used is $\lambda$ are so set that:

when the inner conductor has been received into the outer conductor the electrical length is $\lambda/4$; and when the inner conductor has been pulled out of the outer conductor the electrical length is in the range of $3\lambda/5$ to $5\lambda/8$.

* * * * *